United States Patent [19]

Berkovitz

[11] Patent Number: 5,059,467

[45] Date of Patent: Oct. 22, 1991

[54] PROTECTIVE BALLISTIC PANEL HAVING AN INTERIOR HERMETICALLY SEALED AIR SPACE

[75] Inventor: Azriel Berkovitz, Kfar-Saba, Israel

[73] Assignee: Eagle, Military Gear Overseas Ltd., Tel-Aviv, Israel

[21] Appl. No.: 395,699

[22] Filed: Aug. 18, 1989

[30] Foreign Application Priority Data

Nov. 15, 1988 [IL] Israel ..... 88384

[51] Int. Cl.[5] ..... B32B 3/10; F41H 1/02; F41H 5/04

[52] U.S. Cl. ..... 428/137; 428/67; 428/76; 428/259; 428/911; 428/34; 428/215; 428/216; 428/192; 428/69; 428/68; 428/314.4; 428/314.8; 428/138; 428/246; 428/251; 428/252; 428/284; 428/408; 428/902; 2/2; 2/2.5; 2/44; 2/102; 89/36.02; 89/36.05

[58] Field of Search ..... 428/137, 67, 76, 259, 428/911, 34, 215, 216, 192, 69, 68, 314.4, 314.8, 138, 246, 251, 252, 284, 408, 902; 89/36.02, 36.05; 2/2, 44, 102, 92, 2.5

[56] References Cited

U.S. PATENT DOCUMENTS

| | | | |
|---|---|---|---|
| 3,567,568 | 3/1971 | Windecker | 428/911 X |
| 3,813,281 | 5/1974 | Burgess et al. | 2/2.5 |
| 4,090,005 | 5/1978 | Morgan | 428/911 X |
| 4,200,677 | 4/1980 | Bottini et al. | 2/2.5 |
| 4,229,473 | 10/1980 | Elber | 428/113 |
| 4,312,903 | 1/1982 | Molari, Jr. | 428/34 |
| 4,584,228 | 4/1986 | Droste | 428/182 |
| 4,608,717 | 9/1986 | Dunbavand | 428/911 X |
| 4,622,249 | 11/1986 | Bowser | 428/34 |
| 4,774,724 | 10/1988 | Sacks | 2/2.5 |

FOREIGN PATENT DOCUMENTS

| | | |
|---|---|---|
| 3134341 | 5/1982 | Fed. Rep. of Germany . |
| 1102646 | 10/1955 | France . |
| 2516646 | 5/1983 | France . |

*Primary Examiner*—Ellis P. Robinson
*Assistant Examiner*—William P. Watkins, III
*Attorney, Agent, or Firm*—Pollock, Vande Sande and Priddy

[57] ABSTRACT

A protective ballistic panel includes a first-impact, front layer and a spaced rear layer each of which is made of a relatively tough, nonmetallic material. The front and rear layers are connected to one another at their respective peripheries by an intermediate peripheral strip made of an at least semi-elastic material such as formed polyurethane or rubber. The peripheral strip together with the front and rear layers define an enclosed hermetically sealed air space betweeen said front and rear layers. The front and rear layers are each of laminated construction and comprise plural plies of composite material such as Kevlar, glass fibers, ballistic nylon and graphite fibers. The protective capacity of the first-impact front layer can be increased by providing a plurality of Kevlar plies therein together with at least one intercalated ply of Mylar film, all of the plies of the front layer being connected together by a laminating compound or by rivets.

8 Claims, 1 Drawing Sheet

PROTECTIVE BALLISTIC PANEL HAVING AN INTERIOR HERMETICALLY SEALED AIR SPACE

Figure 1:
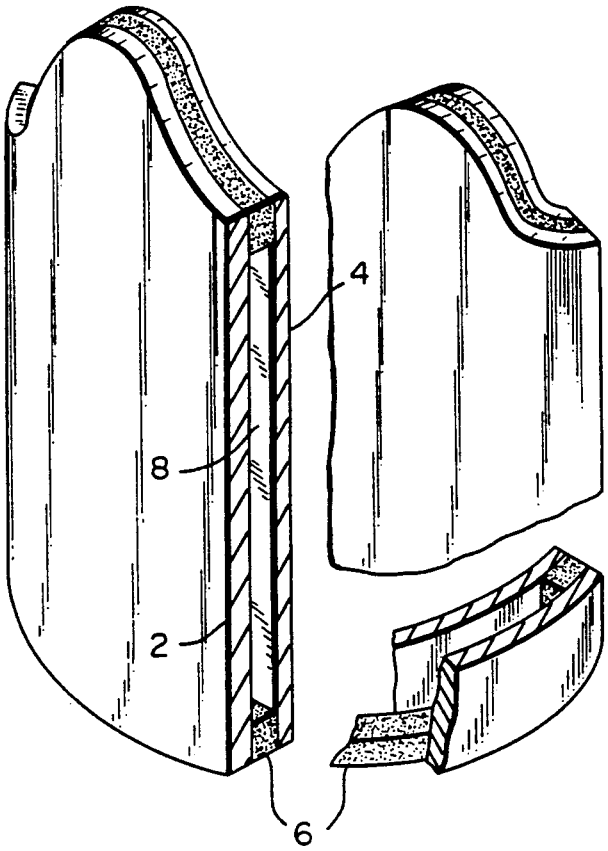

The present invention relates to a ballistic panel for protection against projectiles, shrapnel, and the like.

In recent years increasing use has been made, for armoring purposes, of composite materials based on fibers of ballistic nylon, glass fibers, graphite fibers, (an aromatic polyimide), Kevlar and others. Armor panels made of composites formed of these and similar materials excel in their stopping power, which is higher than that of the metal plates used before.

These panels are used as body armor (e.g., bullet-proof vests), appropriately are shaped as protective helmets, and are used in aircraft (seats of attack helicopters to protect the gluteal region of the crew) and on ground vehicles (walls of armored personnel carriers).

Two general criteria are decisive as to the protective efficacy of a ballistic panel:

a) Its capability of stopping a projectile or shell fragment:

b) Its capability of absorbing the momentum of the projectile or fragment and distribute it over the panel surface, to prevent what is known as "trauma effect", the latter referring to the effect due to non-penetrative impact on the protective panel which is liable to produce a local deformation that, propagated to the body of the wearer, may cause injuries such as serious contusions, broken ribs, etc., While prior-art, single-layer or monolithic ballistic panels may have been satisfactory with respect to the first of the above criteria, they failed with respect to the second, being unable to eliminate the trauma effect. Another disadvantage of the prior-art panels is their high cost, which is due to the very high price of the above mentioned composite materials.

It is one of the objects of the present invention to overcome the disadvantages of the prior-art ballistic panels, and to provide a panel that has not only a very high projectile-stopping capability, but is also relatively free of the trauma effect, and that, furthermore, requires less of the expensive composite material to produce a given projectile-stopping capability or, alternatively, shows a higher stopping capability for the same weight of composite used.

According to the invention, this is achieved by a protective ballistic panel comprising a first-impact, front layer and a rear layer in spaced-apart relationship, both made of a relatively tough, nonmetallic material, and a connective, intermediate layer in the form of an at least peripheral strip made of an at least semi-elastic material, wherein said peripheral strip substantially hermetically encloses and, together with said front and said rear layer, defines an air space.

The invention will now be described in connection with certain preferred embodiments with reference to the following illustrative figures so that it may be more fully understood.

With specific reference now to the figure in detail, it is stressed that the particulars shown are by way of example and for purposes of illustrative discussion of the preferred embodiments of the present invention only and are presented in the cause of providing what is believed to be the most useful and readily understood description of the principles and conceptual aspects of the invention. In this regard, no attempt is made to show structural details of the invention in more detail than is necessary for a fundamental understanding of the invention, the description taken with the drawing making apparent to those skilled in the art how the several forms of the invention may be embodied in practice.

In the drawing:

FIG. 1 is a perspective view, including a vertical and a partial horizontal cross section of the ballistic panel in the form of a bullet-proof vest according to the invention.

Referring now to the drawing, there is seen in FIG. 1 as a non-restrictive, actual example, a part of a body armor, such as a bullet-proof vest, consisting of a first-impact front layer 2 made from a relatively heavy (6–7 mm) sheet of one of the above- mentioned composite materials, and a rear layer 4 of the same material, but thinner (0.8–1.5 mm). Each of these "layers" is itself a laminate comprising a plurality of basic plies, the heavy first-impact front layer 2 of the embodiment shown being formed of 30 basic plies, and thinner rear layer 4 being formed of 5 plies, the panel thus comprising a total of 35 plies.

These two layers 2, 4 are connected to one another by a strip 6 running around the entire periphery of the armor' the strip 6 being cemented on one of its sides to layer 2, and being cemented on the other side to layer 4. The peripheral strip 6 is advantageously made of a semi-elastic, closed-cell, foamed material such as, e.g., polyurethane or, alternatively, a similarly processed rubber. Assembling the two layers 2 and 4 and the peripheral strip 6 produces an air space 8, that is substantially hermetically sealed off by the strip 6 and has a width determined by the thickness of the strip, i.e., about 12 mm.

Given the above design, the previously mentioned advantages of the ballistic panel according to the present invention are due to the following:

1) Part of the impacting projectile's energy causes deformation of the peripheral strip 6 between the layers 2 and 4, and is absorbed by the strip being turned into heat.

2) Between the two layers 2 and 4 there is created a pillow of air confined in space 8 by the peripheral seal formed by the strip 6. This air pillow constitutes itself an elastic element diffusing the projectile's momentum over the large surface of the rear layer 4, thereby preventing local deformation of the latter in the region of the hit. i.e., preventing or at least greatly attenuating the trauma effect.

Comparative tests with pointed ammunition showed the ballistic panel according to the invention to stop projectiles that penetrated a conventional monolithic ballastic panel. Attenuation of the trauma effect was tested on targets consisting of the respective ballistic panels to be compared, backed by a 10 cm plasticine layer. Using round-nosed ammunition, the indent produced in the Plasticine backing by the projectiles hitting the ballistic panels had a depth of 16 mm with the panel according to the invention, as against a depth of 32 mm with a conventional, single-layer ballistic panel consisting of the same amount of plies (35).

A distinct enhancement of the protective capacity of the ballistic papel according to the invention was seen to result from the intercalation, between the plies of the heavy front layer 2, of a single ply of Mylar film, a polyethylene teraphtalate compound. For instance, if, as given earlier by way of example, the front layer 2 was composed of 30 single plies of Kevlar, the above improvement would demand the inclusion, say, as 16th ply, of a Mylar film conforming in shape to the shape of the Kevlar plies, in the front layer, but being provided with a plurality of perforations through which the laminating compound (which will not join Kevlar and Mylar) will bind the 15th and 17th Kevlar plies. To even better ensure the integrity of the front layer 2, it was found helpful, after intercalation of the Mylar ply, and prior to the assembly of the entire panel, to rivet the Kevlar/Mylar/Kevlar composite together.

It will be evident to these skilled in the art that the invention is not limited to the details of the foregoing illustrative embodiments and that the present invention may be embodied in other specific forms without departing from the spirit or essential attributes thereof. The present embodiments are therefore to be considered in all respects as illustrative and not restrictive, the scope of the invention being indicated by the appended claims rather than by the foregoing description, and all changes which come within the meaning and range of equivalency of the claims are therefore intended to be embraced therein.

What is claimed is:

1. A protective ballistic body error panel adapted to be placed in proximity to a portion of the body of a person to be protected by said panel comprising a first-impact front layer and a rear layer having inner facing surfaces disposed in spaced-apart relationship to one another, both of said layers being made of a relatively tough, nonmetallic material capable of withstanding and absorbing impacts, said front and rear layers being connected to one another at their respective peripheries by an intermediate peripheral sealing strip made of an at least semi-elastic material, said peripheral strip being disposed between the inner facing surfaces of said front and rear layers and together with said front and said rear layer defining an enclosed hermetically sealed air space between said front and rear layers.

2. The ballistic panel as claimed in claim 1, wherein said front and rear layers are each made of a material selected from a group consisting of composites comprising Kevlar, glass fibers, ballistic nylon and graphite fibers.

3. The ballistic panel as claimed in claim 1, wherein said peripheral strip is made of a closed-cell, foamed material selected from a group consisting of polyurethane and rubber.

4. The ballistic panel as claimed in claim 1, wherein said front and rear layer are of unequal thickness, said front layer being heavier than said rear layer.

5. The ballistic panel as claimed in claim 8, further comprising at least one ply of a plastic film intercalated between the plies of said front layer, which film is provided with a plurality of perforations.

6. The ballistic panel as claimed in claim 5, wherein said film is a Mylar film.

7. The ballistic panel as claimed in claim 5, wherein the plies of said front layer, including said intercalated ply, are riveted together.

8. The ballistic panel as claimed in claim 1 wherein both said front layer and said rear layer consist of a plurality of plies.

* * * * *